US007497492B2

(12) United States Patent
Gonzalez et al.

(10) Patent No.: US 7,497,492 B2
(45) Date of Patent: Mar. 3, 2009

(54) HYDRAULIC AUXILIARY HOIST AND CRANE CONTROL FOR HIGH PRECISION LOAD POSITIONING

(75) Inventors: Jesus Gonzalez, Madrid (ES); Luis Sordo, Madrid (ES)

(73) Assignee: Actuant Corporation, Glendale, WI (US)

( * ) Notice: Subject to any disclaimer, the term of this patent is extended or adjusted under 35 U.S.C. 154(b) by 0 days.

(21) Appl. No.: 10/594,139

(22) PCT Filed: Mar. 28, 2005

(86) PCT No.: PCT/US2005/010302

§ 371 (c)(1),
(2), (4) Date: Jun. 8, 2007

(87) PCT Pub. No.: WO2005/094296

PCT Pub. Date: Oct. 13, 2005

(65) Prior Publication Data

US 2007/0284327 A1 Dec. 13, 2007

Related U.S. Application Data

(60) Provisional application No. 60/556,577, filed on Mar. 26, 2004.

(51) Int. Cl.
*B66C 13/04* (2006.01)

(52) U.S. Cl. ..... 294/67.5; 294/82.12; 212/274

(58) Field of Classification Search ..... 294/67.5, 294/81.3, 81.4, 82.12, 82.15, 86.41; 212/274
See application file for complete search history.

(56) References Cited

U.S. PATENT DOCUMENTS 4,191,300 A 3/1980 Beghi et al.

(Continued)

FOREIGN PATENT DOCUMENTS

DE 2335407 A1 1/1975
FR 2301475 A 9/1976

OTHER PUBLICATIONS

European Patent Office; Supplementary European Search Report for corresponding application EP 05731556; dated Mar. 26, 2008.

(Continued)

*Primary Examiner*—Dean J Kramer
(74) *Attorney, Agent, or Firm*—Quarles & Brady LLP

(57) ABSTRACT

A hoist for positioning a load (40) includes a plurality of lift cylinders (15), a plurality of position sensors, a plurality of electronically controlled valves, a user input device (22), and a hoist controller (20). Each of the hydraulic hoist cylinders is coupled at one end to the hoist and at an opposite end to the load at a lifting point (45). Each of the position sensors is associated with one of the hoist cylinders and operable to provide position data for the associated hoist cylinder. The electronically controlled valves are hydraulically coupled to the hoist cylinders for extending and retracting the associated hoist cylinders. The user input device is operable by a user to specify load data. The hoist controller is operable to receive the load data from the input device and the position data from the position sensors and in response thereto to control the electronically controlled valves so as to position the load according to the load data.

18 Claims, 3 Drawing Sheets

U.S. PATENT DOCUMENTS

| | | | |
|---|---|---|---|
| 5,022,543 | A | 6/1991 | Versteeg |
| 5,617,964 | A | 4/1997 | Lucking et al. |
| 6,021,911 | A | 2/2000 | Glickman et al. |

OTHER PUBLICATIONS

International Search Report and Written Opinion Under Date of Mailing of Nov. 4, 2005, in connection with International Patent Application No. PCT/US2005/010302.

HYDRAULIC AUXILIARY HOIST AND CRANE CONTROL FOR HIGH PRECISION LOAD POSITIONING

CROSS-REFERENCE TO RELATED APPLICATIONS

This application claims the benefit of U.S. Provisional Patent Application No. 60/556,577 filed on Mar. 26, 2004.

STATEMENT REGARDING FEDERALLY SPONSORED RESEARCH OR DEVELOPMENT

Not applicable.

BACKGROUND OF THE INVENTION

This invention relates generally to hoists for positioning loads during structural fabrication, and in particular, to a hydraulic auxiliary hoist and crane control for high precision load positioning.

Since the advent of hydraulic jacks or lifting cylinders, construction engineers have had the capability to raise and relocate structures, bridges or buildings of almost any size and tonnage—even entire city centers to allow new underground installations such as subways or essential repair work.

Weight is not typically a limiting factor in such positioning operations. A greater weight simply requires more cylinders. However, the extent of a straight lift is limited by the plunger stroke length of the cylinders used. Lifting a greater amount than the limiting stroke length typically requires the use of additional holding arrangements to permit the replacement or repositioning of cylinders for the next stage in the lifting operation.

Using a single crane, a heavy load, such as a large construction segment (roof section, floor section, wall section, large scale architectural ornamentation, bridge section, etc.), can be moved a long vertical distance with relative high speed. However, when precise geometric positioning of the load is required in a vertical and horizontal plane, multiple cranes and elaborate lift rigs are often required. Synchronizing the movements of multiple cranes in this fashion has proved to be difficult and risky. This synchronization difficulty limits the accuracy of the lifting operation and may lead to damage to the load, support fixtures, and/or cranes. Increased risk to the operators and workers is also present in such complicated positioning maneuvers.

Sudden crane starts and stops create oscillations during the critical stages of the lifting process. Weather conditions also provide a source of disturbances during heavy load positioning applications, as wind can blow a lifted section and thereby induce dangerous side loads on the crane, for which the crane was not designed to bear.

One system for positioning a load includes a plurality of hydraulic cylinders attached by cables to a crane or other lift mechanism. The hydraulic cylinders are manually controlled to adjust the position of the load. Such manual systems require multiple jogging operations that can induce oscillations. Moreover, the position of only one cylinder is typically changed at a time. This situation can cause the load to become unbalanced.

Therefore, a need exists for high precision load positioning system that may be implemented without the synchronization and loading issues associated with multiple crane operations or manually controlled lifting cylinders.

BRIEF SUMMARY OF THE INVENTION

The present invention is directed generally to a hydraulic auxiliary hoist and crane control for high precision load positioning. The hoist includes multiple, synchronized hydraulic hoist cylinders for positioning a load.

One aspect of the invention is seen in a hoist for positioning a load. The hoist includes a plurality of lift cylinders, a plurality of position sensors, a plurality of electronically controlled valves, a user input device, and a hoist controller. Each of the hydraulic hoist cylinders is coupled at one end to the hoist and at an opposite end to the load at a lifting point. Each of the position sensors is associated with one of the hoist cylinders and operable to provide position data for the associated hoist cylinder. The electronically controlled valves are hydraulically coupled to the hoist cylinders for extending and retracting the associated hoist cylinders. The user input device is operable by a user to specify load data. The hoist controller is operable to receive the load data from the input device and the position data from the position sensors and in response thereto to control the electronically controlled valves so as to position the load according to the load data.

Another aspect of the present invention is seen where the hoist controller is operable to store geometric data regarding the load and the hoist cylinders and to translate a desired movement of a reference point defined on the load to a position change of at least one of the hoist cylinders to effectuate the desired movement.

Yet another aspect of the present invention is seen in a crane or other lifting device supporting the hoist cylinders for course positioning of the load, the hoist cylinders being controlled for fine positioning of the load.

Other objects, advantages and features of the present invention will become apparent from the following specification when taken in conjunction with the accompanying drawings.

BRIEF DESCRIPTION OF THE SEVERAL VIEWS OF THE DRAWINGS

The invention may be understood by reference to the following description taken in conjunction with the accompanying drawings, in which like reference numerals identify like elements and in which.

Figure 1:
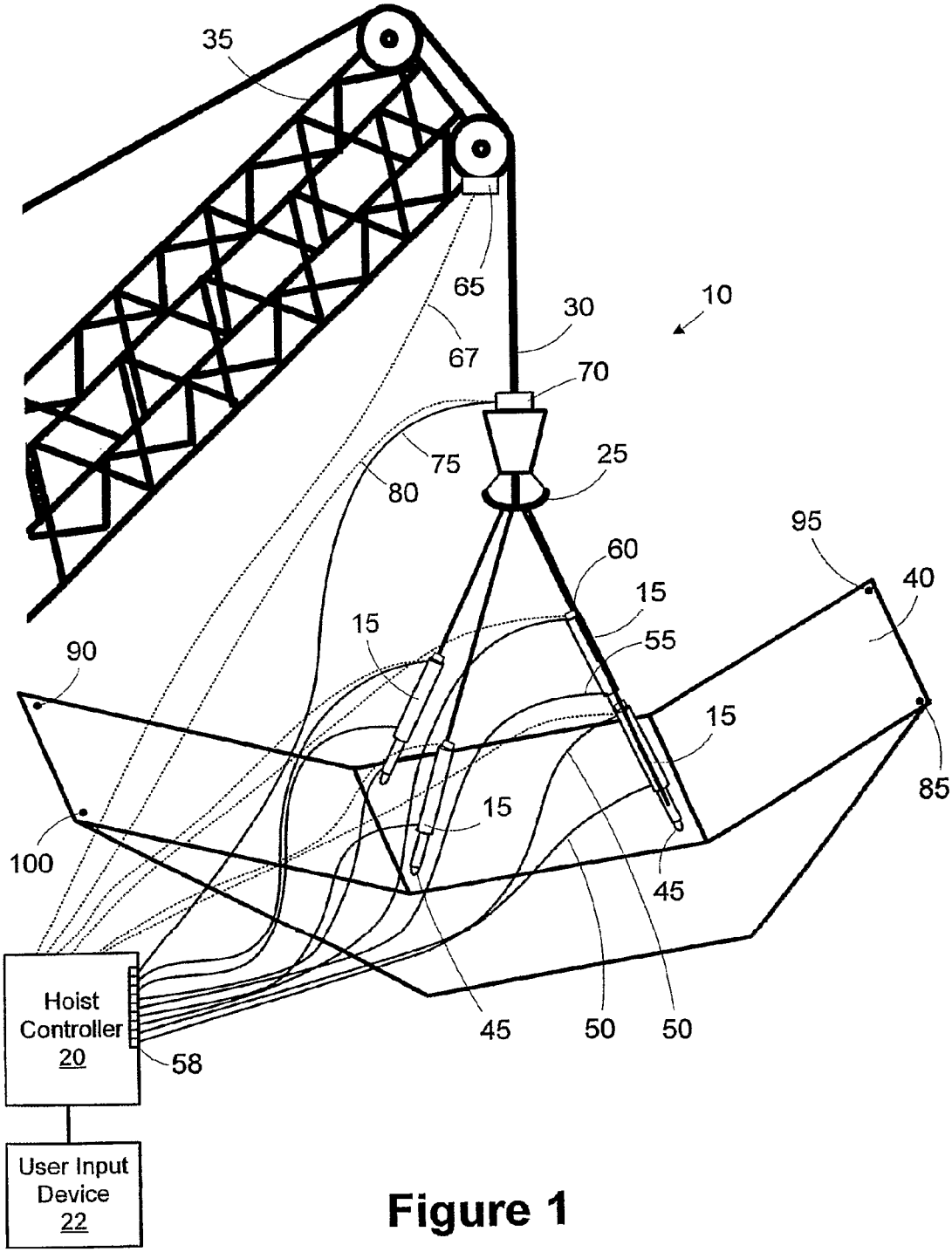
FIG. 1 is a perspective drawing of a hoist constructed in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

While the present invention may be embodied in any of several different forms, the present invention is described here with the understanding that the present disclosure is to be considered as setting forth an exemplification of the present invention that is not intended to limit the invention to the specific embodiment(s) illustrated. Nothing in this application is considered critical or essential to the present invention unless explicitly indicated as being "critical" or "essential."

Referring now to the drawings wherein like reference numbers correspond to similar components throughout the several views and, specifically, referring to FIG. 1, the present invention shall be described in the context of a synchronized hoist 10. The synchronized hoist 10 includes a plurality of hoist cylinders 15 coupled hydraulically and electrically to a hoist controller 20. The synchronized hoist 10 is suspended from a hook 25 coupled to a cable 30 extending from a crane 35 or other lifting device. Each hoist cylinder 15 has an associated extension cable 37 coupling it to the hook 25 providing a common center point. The hoist cylinders 15 are coupled to a load 40 at lifting points 45. Each hoist cylinder 15 is coupled to the hoist controller 20 through hydraulic hoses 50 and a sensor cable 55. For ease of illustration, only the hoses 50 and cable 55 for a single hoist cylinder 15 are numbered. Although four hoist cylinders 15 are illustrated, the application of the present invention is not limited to any particular number of cylinders. For example, two-point, three-point, six-point, etc., configurations may be used. The routing of the hoses 50 and cables 55 illustrated is provided for illustrative purposes to show the connections between the components, and not intended to represent an actual routing. In an actual implementation, bundles or other management techniques may be used to route the hoses 50 and cables 55, and some cables 55 may be shared.

In the illustrated embodiment, the hoist cylinders 15 are equipped with electrical stroke sensors that measure the exact plunger travel of the associated cylinder. Position information from the stroke sensor is provided to the hoist controller 20 over the sensor cable 55. Hence, the position and/or movement of all lifting points 45 can be simultaneously monitored and synchronously controlled. An exemplary type of stroke sensor is a linear variable differential transformer (LVDT).

The synchronized hoist 10 allows high precision load positioning with only a single crane 35. Course positioning of the load 40 may be accomplished by the crane 35. By controlling the individual positions of the hoist cylinders 15, the hoist controller 20 can precisely maneuver the load 40 in both a vertical and a horizontal plane. Course positioning with the crane 35, followed by fine positioning using the synchronized hoist 10 avoids the need to use crane jogging (i.e., sudden starts and stops of the crane 35), which have the potential to cause oscillations of the wire rope and premature wear of the crane brakes. Also, because the hoist cylinders 15 are synchronously controlled by the hoist controller 20, manual jogging of the hoist cylinders 15 is avoided.

Although, the hoist controller 20 is illustrated as a remote unit, it may be integrated with the crane 35. Hence, positioning of the load 40 may be managed from the crane 35 by the crane operator or by other operators near the installation site for the load 40 using a remote unit.

The hoist cylinders 15 are precisely electronically controlled by the hoist controller 20 in their extension. In the illustrated embodiment, the hoist cylinders 15 are double-acting pulling cylinders. The double-acting function allows precise control of both lifting and lowering adjustments in each extension cable 37. The illustrative hoist cylinders 15 have a maximum hydraulic pressure of 700 bar. The pulling capacity of the hoist cylinders 15 depends on the type of application. However, the maximum load is limited by the lifting capacity of the cables 30, 37, not by the hydraulic system. Hoist cylinders 15 having plunger strokes of approximately 1500 mm may be used in hoisting and positioning applications with 4 or 6 lifting points 45.

The type of unit used for the hoist controller 20 may vary, depending on the particular application. For example, the hoist controller 20 may be implemented using a programmable logic controller (PLC) or a general purpose computer programmed with software to implement the load positioning functions. For example, the hoist controller 20 may be implemented using logic similar to that used in an SLCPC-2001 series controller (PC controlled synchronous lift system) offered by Enerpac, an Actuant company having a place of business in Glendale, Wis.

In general, the hoist controller 20 is programmed by an operator via a user input device 22 (e.g., a keyboard and display integrated with or attached to the hoist controller 20) with load data associated with the load 40 and hoist arrangement. For example, the load data may include user instructions associated with load movements, load material, load geometry, lifting point geometry, etc. The hoist controller 20 manages one or more electronically controlled valves 58 for controlling the supply of hydraulic fluid to either side of the pistons in the hoist cylinders 15. The processing device used to implement the logical functions of the hoist controller 20 may be remote from the mechanical system and the valves 58 used to control the positioning of the hoist cylinders 15. A hardwired or wireless connection may be used for communication between the logical and mechanical portions of the hoist controller 20, however, for ease of illustration the hoist controller 20 is shown as a single integrated unit.

The precision provided by the hoist cylinders 15 allows the synchronized hoist 10 to be used in a variety of applications, such as high accuracy relocating, pre-programmed relocating, pre-programmed twisting or turning, and counterweighing (i.e., determining the center of gravity. Exemplary applications include, but are not limited to positioning of roof sections, concrete elements, steel structures, etc. in the construction industry; precise positioning of turbines, transformers, fuel rods, etc. in the utility industry; precise machinery loading, mill roll changes, bearing changes, etc. in the heavy equipment industry; precise positioning of pipe lines, blow out valves, etc. in the petrochemical and oil and gas industry; and relocating and positioning of ship segments in shipbuilding industry.

In some applications additional sensors and or activators may be included in the synchronized hoist 10 to facilitate a higher degree of load control. In one embodiment, the pressure in each hoist cylinder 15, or the force exerted on each hoist cylinder 15, can also be monitored by the hoist controller 20. For example, a sensor 60, such as a load sensing cell or a pressure transducer, may be associated with each hoist cylinder 15, to sense the loading on each hoist cylinder 15. Loading Information from the sensor 60 may be communicated to the hoist controller 20 over the sensor cables 55.

The hoist controller 20 may use loading information from the sensors 60 to balance the load, or to instantaneously, or nearly instantaneously, correct for weather related abnormalities. Additional information regarding weather conditions may be obtained by providing a deflection angle sensor 65 with an associated sensor cable 67 on the crane 35 that indicates the deflection of the cable from vertical (e.g., due to wind). For example, if a wind blows a load sideways, the hoist controller 20 can extend or retract the hoist cylinders 15 to present the smallest possible area for the wind to blow against, to balance the load, or to adjust the hoist cylinders 15 to retain the orientation of the load 40 relative to the structure in which the load 40 is being installed.

The hoist controller 20 may use load information from the sensors 60 and the position information from the hoist cylinders 15 to determine the center of gravity of the load 40. The loading and position information may be resolved into force vectors that allow the characterization of the load 40. The center of gravity information may be used by the hoist controller 20 in determining the adjustments for the hoist cylinders 15 necessary to position the load 40.

The loading capacity limits of the crane 35 may also be programmed into the hoist controller 20 so that the hoist controller 20 may signal an overloading alert condition or automatically make preventative adjustments to the hoist cylinders 15 if the capacity limits of the crane 35 are approached.

Another auxiliary device that may be provided to provide additional information and control functionality for the synchronized hoist 10 is a hydraulic rotary coupling 70 coupled to the cable 30 (e.g., above the hook 25). The rotary coupling 70 may be equipped with an electronic angle sensor indicating the rotational position of the rotary coupling 70 about a vertical axis. An additional hydraulic hose 75 and sensor cable 80 may be provided connecting the rotary coupling 70 to the hoist controller 20. The hoist controller 20 may control the angle of the rotary coupling 70 based on the information from the angle sensor. The rotary coupling 70 provides an additional axis of control to aid in high precision positioning of the load 40.

The hoist controller 20 may be programmed to automatically determine position changes for the hoist cylinders 15 to effect the positioning of various reference points on the load 40. For example, reference points 85, 90, 95, 100 may be defined on the load 40 independent from the position of the lifting points 45. An operator may input to the hoist controller 20 load data, such as the shape, weight or material, and other information that describes the load 40, the position of the lifting points 45, and the position of the reference points 85, 90, 95, 100. In some cases, one or more of the reference points may directly correspond to one or more of the lifting points 45. Formulas or look-up tables can then be programmed into the hoist controller 20 so that the operator can input a specific movement to the hoist controller 20 with respect to one or more of the reference points 85, 90, 95,100. For example, the operator may request that the load 40 at reference point 100 be moved down a certain distance. The movement may also be coordinated with a different reference point. For example, move the load 40 at reference point 100 down a predetermined distance without changing the position of reference point 90. Since the movement of the load 40 by the hoist cylinder 15 associated with reference point 100 may cause the load to rebalance in a different position, an iterative process may be needed to achieve the final position. The hoist controller 20 may complete the iterative process prior to moving the hoist cylinders 15, and execute the movements once a solution is obtained.

The hoist controller 20 may also be programmed with instructions for completing more complex movements, such as moving the positions of all four reference points 85, 90, 95, 100 of the load 40 at the same time. The hoist controller 20 can then calculate how much each of the four hoist cylinders 15 must be extended or retracted to effect the requested movement, and operate the hydraulic control valves to effect the position change. While moving the hoist cylinders 15, the hoist controller 20 may monitor the position sensor associated with each hoist cylinder 15 to retain feedback control over the positioning operation.

Figure 2:
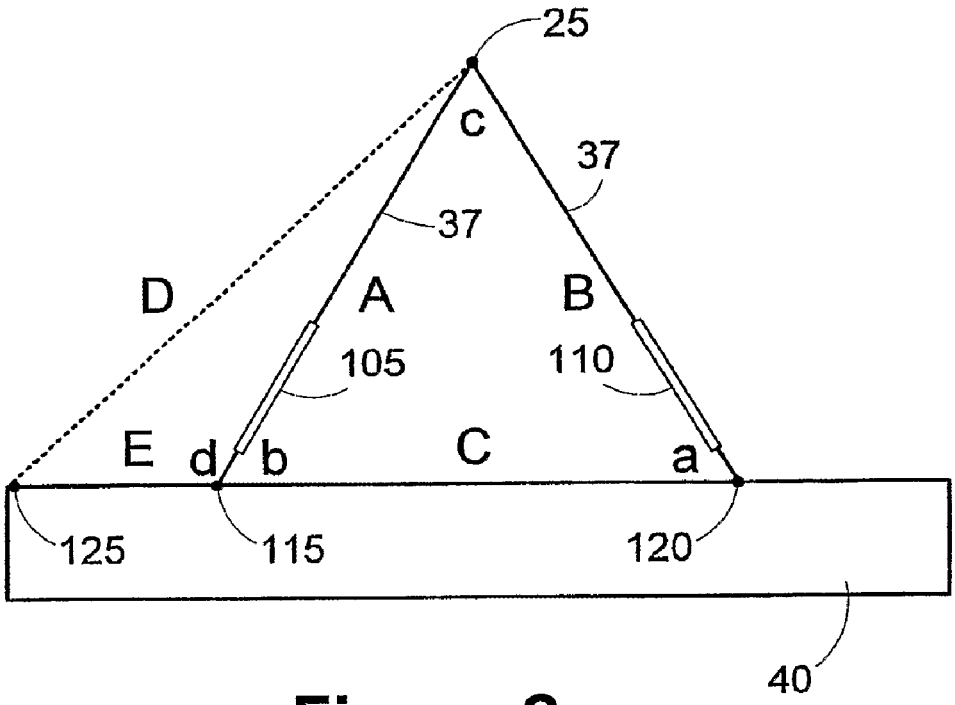
FIGS. 2 and 3 are simplified diagrams illustrating the geometric relationships of a load positioning operation.

Due to the geometry of the synchronized hoist 10, the relationships between the lifting points 45 and the reference points 85, 90, 95, 100 may be defined using triangles with known dimensions. FIG. 2 illustrates an exemplary geometric relationship for a synchronized hoist 10 with two hoist cylinders 105, 110 and their associated lifting points 115, 120. Sides A and B represent the combined lengths of the hoist cylinders 105, 110 and their associated extension cables 37. The side C represents the fixed distance between the lifting points 115, 120. Side D represents the distance between a reference point 125 and the hook 25. Side E represents the fixed distance between the lifting point 115 and a reference point 125. The hoist controller 20 can determine A and B based on the length of the extension cables 37 and the position of each of the hoist cylinders 105, 110.

The geometric relationships between the lifting points 115, 120 and the reference point 125 are known Since C is fixed, the hoist controller 20 can calculate the value of the unknown sides and angles known trigonometric relationships, such as the sine rule:

$$A/\sin(a)=B/\sin(b)=C/\sin(c) \tag{1}$$

and the cosine rule:

$$B^2=A^2+C^2-2\,AC\cos(b) \tag{2}$$

Figure 3:
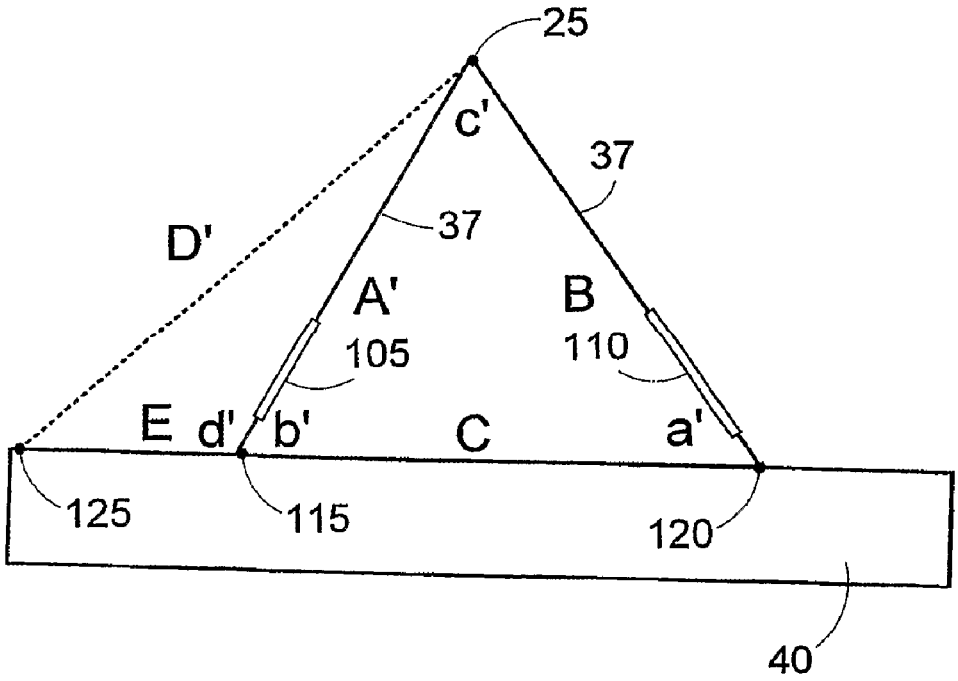

Changes to the lengths of the sides A and B due to the movement of one or more of the hoist cylinders 105, 110 affect the angles (e.g., a, b, c, d) and the lengths of certain sides (e.g., D) of the composite geometry. The effects of these changes can be readily determined using these known trigonometric relationships. For example, FIG. 3 illustrates the changed geometric relationship after the position of the hoist cylinder 105 is changed, as designated by A'. As a result of this change, the angles a', b', c', d' and lengths, D' also change. Values for these changed parameters of the geometry may be determined in advance by the hoist controller 20 to translate a desired position change into a solution for synchronously moving the hoist cylinders 105, 110.

Returning to FIG. 1, as the number of hoist cylinders 15 increases, the number of triangles needed to represent the geometric arrangement increases, but the unknown values may still be determined using the known positions of the hoist cylinders 15 and the trigonometric relationships between the lifting points 45 and the reference points 85, 90, 95, 100.

Figure 4:
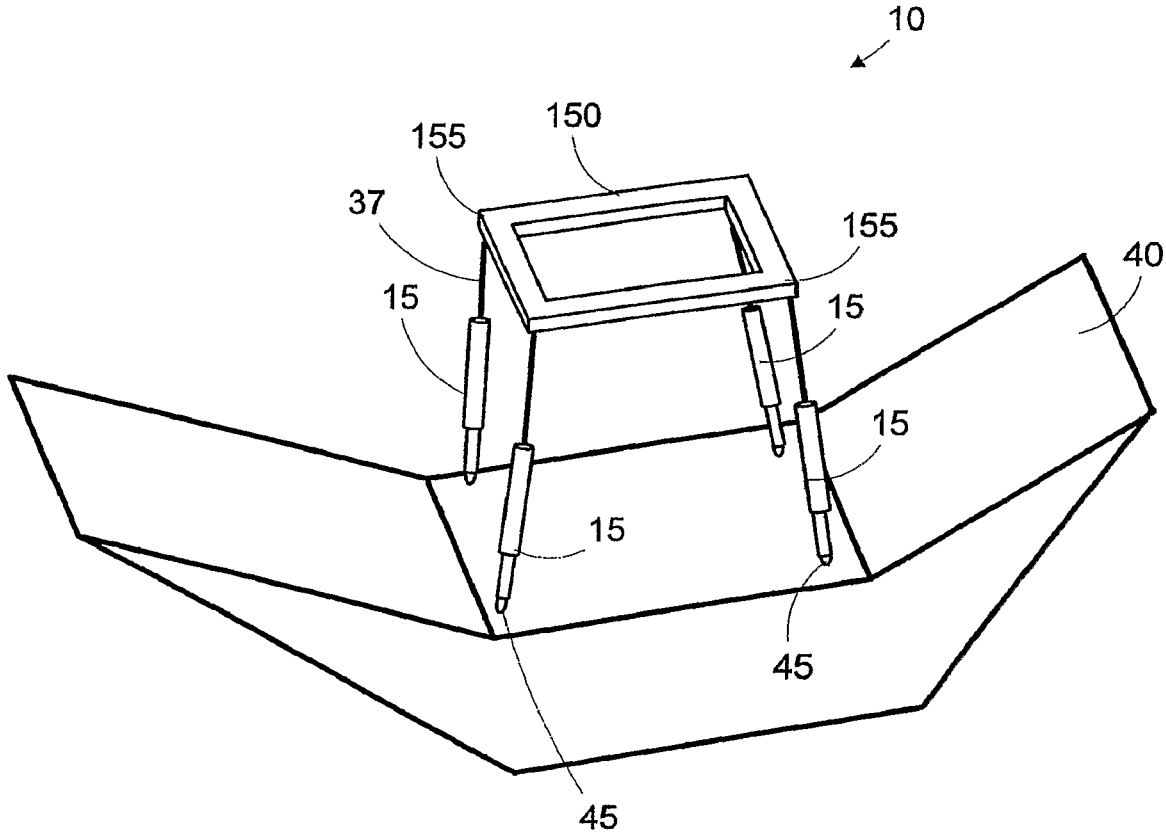
FIG. 4 is a perspective view of a second embodiment of a hoist constructed in accordance with the invention.

Turning now to FIG. 4, a diagram illustrating an alternative embodiment of the synchronized hoist 10 is provided. Rather than the hook 25 serving as a center member, the synchronized hoist 10 further includes a frame 150 from which the extension cables 37 and hoist cylinders 15 extend. For ease of illustration, portions of the lifting system (e.g., the hoist controller 20, crane 35, hoses 50, cables 55, etc.) are omitted. The extension cables 37 and hoist cylinders 15 are attached to corners 155 of the frame 150. The frame 150, in turn, may be coupled by additional cabling to the hook 25. The use of the frame 150 as the center member changes the effects of movement of the hoist cylinders 15 on the movement of the load 40. Because the hoist cylinders 15 are closer to being perpendicular to the load 40 as compared to the embodiment of FIG. 1, movement of the hoist cylinders 15 more closely translates to vertical movement of the load 40 (i.e., the vertical component of the lifting vector is increased relative to the horizontal component. Other type of center members may be used depending on the number of hoist cylinders 15 employed and the geometry of the load 40.

The synchronized hoist 10 of the present invention provides numerous advantages. Because multiple cranes are not required, to achieve high precision positioning, the cost of the operation is reduced, the operating speed is increased, and the risk to the operators is decreased. Positioning precision is increased due to the simplification in the synchronization required to position the load. Moreover, the effects of weather conditions on the effectiveness of the positioning may be reduced, as the load can be reoriented to compensate for and minimize the effects of wind. Because the hoist controller 20 synchronously controls the lift cylinders 15 based on the programmed load data, the smoothness of the positioning operation is increased.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A hoist for positioning a load, comprising:

a plurality of hydraulic hoist cylinders each coupled at one end to the hoist and at an opposite end to the load at a lifting point;

a plurality of position sensors, each associated with one of the hoist cylinders and operable to provide position data for the associated hoist cylinder;

a plurality of electronically controlled valves hydraulically coupled to the hoist cylinders for extending and retracting the associated hoist cylinders;

a user input device operable by a user to specify load data; and a hoist controller operable to receive the load data from the input device and the position data from the position sensors and in response thereto to control the electronically controlled valves so as to position the load according to the load data.

2. The hoist of claim 1, wherein the load data comprises at least one of user instructions associated with load movements, load material, load geometry, and lifting point geometry.

3. The hoist of claim 1, further comprising a center member coupled to the hoist cylinders.

4. The hoist of claim 3, wherein the center member comprises a hook.

5. The hoist of claim 4, wherein the center member comprises a frame.

6. The hoist of claim 3, wherein the center member extends from a cable, and the hoist further comprises a deflection sensor operable to measure a deflection of the cable.

7. The hoist of claim 6, wherein the hoist controller is coupled to the deflection sensor and operable to control a position of at least one of the hoist cylinders as a function of the deflection.

8. The hoist of claim 1, wherein the hoist controller is operable to translate a desired movement of a reference point defined on the load by the load data to a position change of at least one of the hoist cylinders to effectuate the desired movement.

9. The hoist of claim 1, wherein the load data defines a geometric relationship between the lifting points and the reference point, and the hoist controller is operable to determine the position change based on the geometric relationship.

10. The hoist of claim 1, further comprising a rotary coupling coupled to the hoist and operable to rotate the load about a vertical axis.

11. The hoist of claim 10, wherein the rotary coupling is hydraulically operable and hydraulically coupled to the hoist controller, and the hoist controller operable to control a rotational position of the rotary coupling.

12. The hoist of claim 1, further comprising a load sensor associated with each of the hoist cylinders to generate loading data, the hoist controller being coupled to the load sensor to receive the loading data.

13. The hoist of claim 12, wherein the load sensor comprises at least one of a load sensing cell and a pressure transducer.

14. The hoist of claim 12, wherein the hoist controller is operable to store at least one loading limit and compare the loading limit to the loading data to identify an overload alert condition.

15. The hoist of claim 14, wherein the hoist controller is operable to change a position of at least one of the hoist cylinders responsive to identifying the overload alert condition.

16. The hoist of claim 12, wherein the hoist controller is operable to determine a center of gravity of the load based on the loading data.

17. The hoist of claim 1, wherein the plurality of hoist cylinders comprise at least four hoist cylinders.

18. A lifting system for positioning a load, comprising:

a lifting device;

a plurality of hydraulic hoist cylinders each supported at one end by the lifting device and at an opposite end to the load at a lifting point;

a plurality of position sensors, each associated with one of the hoist cylinders and operable to provide position data for the associated hoist cylinder;

a plurality of electronically controlled valves hydraulically coupled to the hoist cylinders for extending and retracting the associated hoist cylinders;

a user input device operable by a user to specify load data; and a hoist controller operable to receive the load data from the input device and the position data from the position sensors and in response thereto to control the electronically controlled valves so as to position the load according to the load data.

* * * * *